US005779529A

United States Patent [19]

Bizer

[11] Patent Number: 5,779,529

[45] Date of Patent: Jul. 14, 1998

[54] THERMOPLASTIC OPTICAL LAP WITH REINFORCED WEBBING

[75] Inventor: Jerry L. Bizer, Louisville, Ky.

[73] Assignee: Bizer Industries, Clarksville, Ind.

[21] Appl. No.: 753,417

[22] Filed: Nov. 25, 1996

[51] Int. Cl.[6] ..... B24B 5/16

[52] U.S. Cl. ..... 451/550; 451/546; 451/548

[58] Field of Search ..... 451/2, 540, 542, 451/546, 548, 550, 905

[56] References Cited

U.S. PATENT DOCUMENTS

| | | | |
|---|---|---|---|
| 1,465,117 | 8/1923 | Dey | 451/550 X |
| 1,651,181 | 11/1927 | Bugbee et al. | 451/550 X |
| 2,988,860 | 6/1961 | Sohl | 451/546 |
| 3,225,497 | 12/1965 | Brandt . | |
| 3,676,960 | 7/1972 | Aspden . | |
| 3,685,214 | 8/1972 | Sarofeen . | |
| 3,896,593 | 7/1975 | Rine | 451/546 X |
| 3,962,400 | 6/1976 | Schneider et al. . | |
| 4,035,160 | 7/1977 | Taguchi . | |
| 4,042,346 | 8/1977 | Sioui et al. . | |
| 4,106,915 | 8/1978 | Kagawa et al. . | |
| 4,212,136 | 7/1980 | Stertzbach . | |
| 4,212,137 | 7/1980 | Rue . | |
| 4,382,803 | 5/1983 | Allard . | |
| 4,541,843 | 9/1985 | Elbel et al. . | |
| 4,821,461 | 4/1989 | Holmstrand . | |
| 4,862,644 | 9/1989 | Stith . | |
| 5,110,278 | 5/1992 | Tait et al. . | |
| 5,157,880 | 10/1992 | Rotenberg et al. . | |
| 5,209,023 | 5/1993 | Bizer . | |

FOREIGN PATENT DOCUMENTS 0436315 12/1990 European Pat. Off. .

*Primary Examiner*—Timothy V. Eley
*Attorney, Agent, or Firm*—Middleton & Reutlinger

[57] ABSTRACT

The present invention defines an optical polishing lap comprising a thermoplastic polymer resin of uniform density, porosity, and texture throughout including the surface of the lap. The optical lap is of unitary construction formed having a solid main body with a generally domed-shaped upper head portion of substantially monolithic form providing an upper curved surface. The optical lap includes a lower flat surface having an attachment means defining an integral base portion extending downward opposite the lower flat surface offset from the main body. The integral base portion defines webbing having a continuous peripheral rail extending around the edge. The peripheral base rail includes parallel side rail means defining a pair of straight outside walls and an angled inside wall sloped inwardly toward the center of the main body and toward one another providing a thicker rail at the intersection of the lower flat surface to provide additional structural strength and dimensional stability to the rails and the main body during use. A pair of reinforcement members composed of metal such as steel, iron, brass, copper, nickel or other material harder and more durable than the dome is integrally formed and embedded within the webbing side rail means normal thereto providing structural support.

11 Claims, 1 Drawing Sheet

THERMOPLASTIC OPTICAL LAP WITH REINFORCED WEBBING

FIELD OF THE INVENTION

This invention relates to optical grinding "laps," particularly to an optical grinding lap comprised of an easily machinable (and re-machineable) thermoplastic polymer having a reinforced webbing integrally incorporating hard reinforcing material such as metal within the lap webbing.

BACKGROUND OF THE INVENTION

In preparing and grinding optical lenses, for example eyeglass lenses, the primary grinding (i.e., the grinding necessary to put the primary focal or optical curvature into the lens(es) according to the eye doctor's prescription) is performed by relatively coarse abrasive materials. The result is that, after the optical curvature is ground into the lens(es), the inside (i.e., interior, concave) surface of the lens is almost opaque from grinding or scratch marks left by the optical grinding cutters.

The prevailing practice in the optometry field is to perform a "secondary" grinding or polishing operation upon those concave surfaces, to remove the grinding lines left by the primary optical cutters. This secondary polishing operation may itself comprise more than one step, but both steps are performed in substantially the same manner. Basically, the eyeglass lens is placed "scratched" (i.e., concave) side down upon a polishing "lap" or, as they are sometimes referred to, polishing master. The receiving surface of the polishing lap is convex, and is usually ground to the exact reciprocal of the concave surface of a particular lens, so there is virtually complete surface mating between the concave surface of the lens to be polished, and the convex surface of the lap upon which the polishing is to be accomplished.

Before the lens is placed upon the lap for polishing, the lap is provided with an abrasive polishing surface, usually in the form of a flexible adhesive-backed abrasive pad, whereby the abrasive pad is flexible enough to conform fully to the surface of the lap. The lens to be polished is impressed upon the lap (with adhesive pad thereon) in such a way that the surface of the lens to be ground is in full contact with the polishing pad upon the lap.

The combined lens-lap-pad is placed onto a polishing machine and the assembly is caused to oscillate or vibrate in the presence of a polishing lubricant and in such a way that the polishing pad and lubricant removes the grinding marks left by the primary optical cutters. Often the polishing is accomplished in conjunction with providing some sort of a mildly abrasive slurry, of approximately the same grit as is applied to the polishing pad, to the lap-pad-lens assembly while the polishing is taking place.

In two stage polishing processes, such as the polishing process utilized by this inventor, after the slurry polishing step is completed, the first polishing pad is removed, and a second, finer (i.e., less gritty, less abrasive) pad is placed upon the lap, the lens reimpressed thereupon, and the lap-pad lens assembly is reoscillated/vibrated, this time usually with only water as the provided solution (although other solvents, even including a minor grit solvent, could be used).

It is generally known and appreciated that the laps must be contoured very precisely, to the inverse curvature of the optometric prescription, so the convex surface of the lap will coincide exactly with the concave surface of the optical lens being polished. This is accomplished on commercial lap cutters which are generally known in the art.

Because of the relatively high cost of machining and the time it takes to machine present laps, laps are presently provided in large number of different starting shapes (as many as 72 lap shapes), shapes which are provided in an estimate of the final ground contour, so as to minimize the amount of lap material which must be machined off to exactly match the prescription contour. In addition, often it is necessary to have more than one set of laps for each pair of glasses, one set for glass lenses, and a second set for plastic lenses. As you might imagine, the inventory of laps in many optical labs is very high.

In addition, even though presently available laps are made of relatively machineable metal (i.e., aluminum; see infra), it still consumes quite a bit of time to grind a lap.

The techniques and procedures just above described are well known and understood in the optical grinding art.

The standard lap that is used in the optical lab industry is made of aluminum, which replaced cast iron as the lap of choice some ten years ago. However, even though aluminum laps provided advantages over cast iron laps because of their noncorrosiveness, relative ease of machineablity and relative (i.e., compared to cast iron, at any rate) low weight, the aluminum laps in use today have the nagging disadvantage of high machine time to grind to the reciprocal contour of the prescription (as much as 6–12 minutes per lap), and their still relatively high weight (about 12 ounces) causes wear and tear on the polishing apparatus. In addition, the time delay caused by multiple passes on the lap cutter tempts the operator to try to machine off too much aluminum in a single pass, and this often results in chipping of the aluminum, commonly called "dinks." If a lap becomes "dinked," it must be thrown away.

For many years, the industry has striven to provide a plastic lap to replace and avoid the problems associated with the use of aluminum laps. While it is well known to use injection molding to produce easily machinable plastic parts, standard injection molding techniques do not produce an acceptably strong lap structure to withstand the mechanical stresses and abuses of the polishing process. This is because in many types of injection molded plastic parts a relatively thin "skin" or "shell" of solid plastic forms the smooth upper lap surface, and the structural integrity (such as it is) of the lap is provided by the standard "webbing" practice well known in the injection molding arts. Other types of plastics form a structurally solid thermoplastic, but tend to exhibit fisheyes or form pores in the surface of the lap due to air entrapped within the plastics. Moreover, the means of holding the laps secure on the vibrating machines requires a durable and strong webbing composed of a tough thermoplastic which resists flexing since the lap is generally secured between the jaws of a clamp or vise type of holding apparatus. Another plastic molding process, compression molding, proved unacceptable because the plastics which are utilizable in compression molding (i.e., thermal set plastics, such as phenolics) are generally brittle, and would crack or chip when attempting to machine them to required contour.

As set forth in my prior U.S. Pat. No. 5,209,023 for a "Thermoplastic Polymer Optical Lap and Method of Making Same", issued on May 11, 1993, a thermoplastic polymer was developed which overcame these problems and provided an acceptable plastic lap through a combination of unique material selection and a molding process which departs substantially from the prevailing teachings ordinarily associated with injection molding. The particular material utilized was a mineral-filled thermoplastic polymer, which was injection molded to its final shape into a superheated mold via an inlet valve or gate which is much, much larger than ordinarily necessary, and also utilized process parameters that exceeded the prevailing published process and design criteria for the material. The process could only be accomplished by an injection molding press that was about three times the size and capacity that would ordinarily be called for to injection mold a part of the size and shape of standard optical laps.

The injection molding limitations which required the use of a particular composite to provide an optical lap having the required physical characteristics have been solved by the present invention which utilizes a material of a different hardness such as metal bars formed integrally within the webbing to provide the required structural rigidity using different types of polymers.

One method of overcoming the inherent flexibility of polymer laps required attaching metal plates onto the bottom of the polymer laps providing a rigid attachment point; however, attachment of the plates with screws or adhesives does not hold and "pop loose" under the extreme stress and vibration associated with the grinding process. Another method of using metal to overcome the flexibility problem is to create slots within the molded lap whereby metal inserts are added after the molding process; however, the two piece laps usually come apart during prolonged and extended use. The present invention overcomes the deficiency by utilizing a rigid material such as metal bars or a tough hard polymer as a reinforcement members integrally embedded into the thermoplastic during the molding process. Thus, the present invention provides a means to utilize other thermoplastic polymers such as polypropylene, acrylonitrile butydiene styrene ("ABS"), polycarbonates, or other types of polymers as the selected substrate for producing the optical lap.

SUMMARY OF THE INVENTION

The present invention defines an optical polishing lap comprising a thermoplastic polymer resin of uniform density, porosity, and texture throughout including the surface of the lap. The optical lap is of unitary construction formed having a solid main body with a generally domed-shaped upper head portion of substantially monolithic form providing an upper curved surface. The optical lap includes a lower flat surface having an attachment means defining an integral base portion extending downward opposite the lower flat surface offset from the main body. The integral base portion defines webbing having a continuous peripheral rail extending around the edge. The peripheral base rail includes parallel side rail means defining a pair of straight outside walls and an angled inside wall sloped inwardly toward the center of the main body and toward one another providing a thicker rail at the intersection of the lower flat surface to provide additional structural strength and dimensional stability to the rails and the main body during use for attaching said lap to a lap grinding machine, a lap cutter, or an optical polishing machine. A pair of reinforcement members composed of metal such as steel, iron, brass, copper, nickel or other material harder and more durable than the dome is integrally formed and embedded within the webbing side rail means normal thereto providing structural support. The peripheral base rail further defines an end rail means conforming to the curvature of the main body of the dome.

The primary object of the present invention is to provide a plastic lap which will provide the same utility as an aluminum lap, but without the attendant disadvantages of high weight and high machining cost, whereby the use plastic lap is a bicomposition lap comprising a reinforcement member(s) of selected thermoplastic and a harder more rigid material integrally bedded within the webbing to provide structural strength.

It is an object of the present invention to provide a means of forming an optical lap using conventional injection molding equipment.

It is another object of the present invention incorporates at least one reinforcement member composed of a harder material than the lap body to provide a thermoplastic optical lap which utilizes metal such as steel, brass, copper, aluminum, zinc, nickel or alloys thereof, or other hard polymer materials such as fiberglass, aramida or graphite fibers, polymer composites, or even combination of metal and polymers as a means of reinforcement integrally embedded in the webbing of the thermoplastic lap.

It is another object of the present invention to provide a thermoplastic optical lap which utilizes a reinforcement polymer material of a different composition and/or hardness in the webbing to provide structural strength to the lap, so that a variety of thermoplastic polymers may be selected from polymeric materials such as polypropylene, nylon, acrylonitrile butydiene styrene (ABS), polycarbonate, polyvinyl chloride (PVC), polyethylene.

It is an object of the present invention to provide an optical polishing lap which is substantially more easily machinable than an aluminum polishing lap without dinking, yet is mechanically serviceable to withstand the mechanical abuses of the polishing apparatus.

It is another object of the present invention to form a locator tab integrally within the webbing to provide an adaptation means for use of the lap on a LOWELL® type of optical lap machine.

It is another object of the present invention to form a square of about ½ inch in the center of the webbing as an attachment point for lap machines.

It is a further object to provide a polishing lap which is substantially reduced in cost compared to aluminum laps.

It is a further object to provide a polishing lap that is capable of multiple remachinings (sometimes referred to as "trueing").

It is a further object to provide a polishing lap which is so easily machinable that the number of pre-machined sizes can be, and is, startlingly reduced. At the present time, it is contemplated that, because the laps of the present invention are so easily and quickly machinable, the number of stock sizes provided will be four (4), compared to the 72 required by the present art. It is possible that the number of standard starter sizes provided will ultimately only be two (2).

Other objects and uses will become apparent to those skilled in the art, after review of the drawings and detailed description below, but such other objects and uses do not depart from the scope and spirit of the present invention

DETAILED DESCRIPTION OF THE PREFERRED EMBODIMENT

Figure 1:
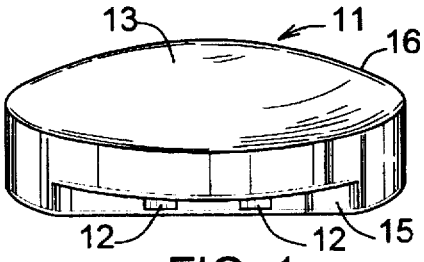
FIG. 1 is a top perspective view of an optical lap made according to the present invention showing the ends of the reinforcement members extending from the sides.

Referring now to FIG. 1, disclosed is a generally round optical lap 11 of thermoplastic polymer, preferably (e.g., 6.6 nylon), comprising a monolithic dome shaped body portion 13 formed integrally with a generally rectangular base 15. As shown best in FIG. 2, the base 15 consists of integrally formed webbing 18. It is possible to utilize a solid base without webbing; however, the extra weight and expense of the material are factors which must be taken into account in the design of a thermoplastic lap 11 as a substitute for metal laps. Therefore, the design of the integral webbing 18 is an important and critical feature to the success of a lightweight thermoplastic lap 11.

The base of FIG. 1 shows the distal ends 12 of the reinforcement members 14 integrally embedded within the base 15. Preferably, the lap 11 incorporates at least one reinforcement member 14 composed of a harder material than the lap body 13 comprising a metal such as steel, brass, copper, aluminum, zinc, nickel or alloys thereof as a means of reinforcement integrally embedded in the webbing 18 of the thermoplastic lap 11. Of course, the reinforcement polymer may be selected from materials such as fiberglass, graphite, or other polymer composite having a different hardness than the domed body 13 and face 16 of the lap 11. More preferably, the reinforcement members 14 are composed of iron or steel to provide a convenient means for orienting and holding the reinforcement members 14 into position during the over molding process. Utilization of integrally embedded reinforcement members 14 with the base 15 provides means for forming a thermoplastic optical lap 11 which utilizes a reinforcement polymer material of a different composition and/or hardness in the base 15 to provide structural strength to the lap 11.

Referring to FIGS. 1–8, the lap 11 is provided in circular form of diameter D of approximately (e.g., 3.165") with cylindrical sides of a height H of approximately (e.g., 0.650"), or other shapes such as oblong (not shown) which are known in the optical grinding arts. Dome shaped portion 13 is provided with a rise R (e.g., an arc with a diameter of about 3.50") extending from the upper end of sides H to the apex of the dome, indicated by point A. At present, D, H and R are provided in numerous varieties of dimensions known in the optical industry, and one of the principal benefits of the present invention is that the present invention can eliminate the high number of different dimensions available to four, or even possibly two.

To make an integral thermoplastic polymer optical lap it was previously necessary to utilize an injection molding process which departed in several material respects from standard injection molding techniques. As set forth in my previous U.S. Pat. No. 5,209,023, hereby incorporated by reference, the material found to work best for a thermoplastic polymer lap is a mineral filled thermoplastic polymer, namely 6.6 nylon with 40% talc filler. Of course it is contemplated that the thermoplastic polymer lap may incorporate glass fibers or carbon fibers or combinations thereof as fillers separate from or in addition to mineral fillers. The particular brand which has demonstrated successful results is DUPONT's MINLON 1OB40 nylon. Other thermoplastic polymers could be used; however, our experiments showed that most thermoplastic polymers did not exhibit all of the physical characteristics necessary to provide a nonflexing base and a tough resilient surface which was smooth and free from fisheyes and voids or other imperfections and could be injection molded with standard equipment.

Moreover, the it was determined by experimentation that even after selection of a thermoplastic which met the required physical characteristics it was necessary to devise a new process for making the lap in order to provide a truly superior thermoplastic polymer lap superior to aluminum laps and to still be less expensive.

Although the present invention utilizing at least one integrally formed embedded reinforcement member or reinforcement members can be manufactured using conventional injection molding techniques, the preferred embodiment of the lap 11 is manufactured according to the process set forth in U.S. Pat. No. 5,209,023 with modifications to the process necessary for insertion of the reinforcement members. The utilization of a reinforcement member such as metal or other selected thermoplastic polymers such as polypropylene, polyvinyl chloride, acrylonitrile butydiene styrene ("ABS"), polycarbonates, or other types of previously unacceptable polymers may be selected for producing the optical lap because the structural requirements for the base 15 may be ascertained by using a reinforcement member. Therefore the injection molding process utilizing selected pressure and temperature parameters can be conducted to optimize the other physical requirements of the lap to obtain a uniform smooth surface for different selected thermoplastic polymers depending upon the melt characteristics of the particular polymer. This represents an opportunity for a significant cost savings.

In the present process the preferred thermoplastic polymer is still nylon because of the physical characteristics and economics. The thermoplastic is first heated above its published working range. Second, a substantially larger than ordinary "gate" size is used, about two to three times the size ordinarily used in "conventional" injection molding processes, to accommodate the rush of extraheated thermoplastic material into the mold cavity. Third, the mold itself is heated to a high degree to avoid the thermoplastic polymer establishing a "skin" or "shell" when first contacting the mold walls. Fourth, the molding pressures utilized are above the published working range. Because of these differences, it has been found that a surprisingly large injection molding machine is necessary to adequately accommodate this process and produce acceptable laps. When first confronted with the desired dimensions and expected volume of the lap (about 6 ounces), "conventional wisdom" in the injection molding arts predicted that the laps could be produced on a 100 ton injection machine, which is usually associated with a 6 ounce "shot" (i.e., the volume of the mold cavity to be filled). However, because of the substantial departures from "conventional wisdom," the laps of the present invention require an injection molding machine with a 300 ton capacity with an 18 ounce shot capacity. The particular injection molding machine utilized was manufactured by Reed Manufacturing Company (now no longer producing machines in its own name), but other injection molding suppliers could provide adequate substitutes.

The thermoplastic polymer is heated above its recommended temperature range, in the case of MINLON 1OB40 to 610 degrees fahrenheit more or less, which is above the published working range of 520–580 degrees. Of course, care must be exercised to not overheat the polymer and destroy its as-molded properties, but the present upper limit of temperature beyond the published processing temperatures is unknown. By such raising the temperature of the thermoplastic polymer, it is possible to obtain higher working temperatures in the injection molding machine (e.g., a nozzle temperature of 560 degrees), which renders the thermoplastic polymer capable of more rapid flow into the mold cavity.

To facilitate the rapid injection of the high amount of polymer into the mold, it is necessary that a much larger than ordinary gate be used, depicted in the drawings at numeral 27. In making a three inch diameter round lap with a 3.5 inch diameter dome with sides H of about 0.650," and those of similar size, ordinarily a screw runner gate size of about 0.10"–0.15" would be called for, a ratio of gate size diameter to height H between about 0.154 to about 0.230. To make an acceptable lap using nylon as the thermoplastic, a gate size of 0.250"–0.375" is used, a corresponding ratio of about 0.33 to 0.75, or some two to five times the ordinary gate size. This permits a sufficiently rapid flow of hot thermoplastic polymer into the mold to fill up the cavity before the thermoplastic begins to set.

The mold itself is made of steel, the usual material for an injection mold, and perhaps the "female" core portion of the mold is provided with copper or some other highly conductive metal. The mold is preferably maintained at a temperature around 200–210 degrees, which is almost twice as hot as the ordinary temperature (e.g. 120 degrees) called for by "conventional" injection molding practices, also a substantial departure from the "conventional wisdom" of the injection molding art. Again, the elevated temperature of the heated mold restricts the skin forming tendencies of the thermoplastic polymer when it first contacts the mold walls.

The final departure from the "conventional wisdom" of the injection molding art is the use of higher molding pressures than the published working ranges. In making the laps of the present invention, a two stage pressing operation is used, the first stage at a pressure of 1200 pounds for about 36 seconds, and the second high pressure range for an additional 36 seconds at 1800 pounds pressure. This converts to a "high" pressure of about 15–25 percent above the published molding pressure ranges for mineral filled 6/6 nylon.

When completed, the laps of the present invention provide a dimensionally stable thermoplastic polymer which is remarkably easier to machine than an aluminum lap. For example, to grind or cut an aluminum lap, it usually requires three or more passes to finally grind the lap to its desired contour, a process which takes about 6–8 minutes. A thermoplastic optical lap made according to the present invention can machined in one pass on the same lap cutter, in about 45 seconds. The resulting finished thermoplastic lap will weigh about 6 to 8 ounces, compared to about 11 ounces for an aluminum lap. This substantial reduction in weight will no doubt prolong life of the polishing equipment, as well as the lap cutters themselves.

While utilization of the reinforcement member(s) 14, provide a means for using conventional injection molding equipment and processing parameters, the technique of using higher pressures and temperatures than normally used with injection molding for the selected thermoplastic polymer is still recommended due to the smooth surface required for the finished product.

The integral base 15 of the lap 11 of the present invention utilizes a web having an integrally embedded reinforcement member 11 in contrast to the teachings of my prior U.S. Pat. No. 5,209,023 which utilized a substantially solid base, because of the discovery that use of the reinforcement member provides a means for utilizing other thermoplastics and more conventional injection molding techniques.

As stated heretofore, one object of the present invention is to provide an integrally webbed reinforced base 15. The lap 11 of the present invention provides a means to utilize polymers other than nylon to provide an integrally formed lap 11. The separation problems associated with a two piece lap utilizing a metal plate secured to a thermoplastic dome structure by screws or adhesive means is solved by utilization of a rigid material such as metal bars or a tough hard polymer as a reinforcement members 14 integrally embedded into the base 15 of the thermoplastic lap 11 during the molding process. The reinforcement members 14 are oriented with the ends being normal to the jaws of the vise of clamp lap cutter holding means to prevent flexing and provide structural support necessary to hold the lap 11 secure during the cutting process. The reinforcement member 14, or reinforcement members 14 as two member are used in the preferred embodiment, are hand loaded into the mold. The metal, which is preferably iron, steel or some other material incorporating a magnetically affected type material, is held into position by magnets. An overmolding technique is used during the injection molding process to integrally embed at least a portion of the reinforcement members 14 within the base 15 formed integrally with the lap body 13. As the thermoplastic cools and shrinks the reinforcement members are hermetically sealed within the base 15. Of course, other means known in the injection molding art may be used to hold nonmetallic or nonmagnetic in position during the process. Thus, the use of the reinforcement members 14 in the present invention provides a means to utilize other thermoplastic polymers such as polypropylene, acrylonitrile butydiene styrene ("ABS"), polycarbonates, or other types of polymers as the selected substrate for producing the optical lap 11.

The optical lap 11 includes a lower flat surface having an attachment means defining the integral base portion 15 extending downward defining a lower flat surface 17 offset inwardly from the main body 13 about 0.25 inches. The base 15 of the lap 11 of the present invention is formed having an integral webbing 18 to decrease weight and increase the structural strength of the base 15.

Figure 2:
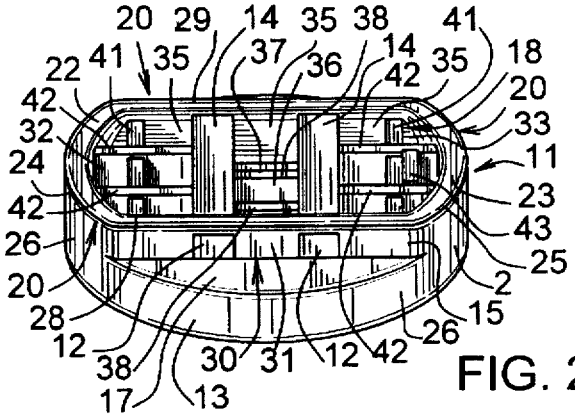
FIG. 2 is a bottom perspective view of an optical lap made according to the present invention.
Figure 3:
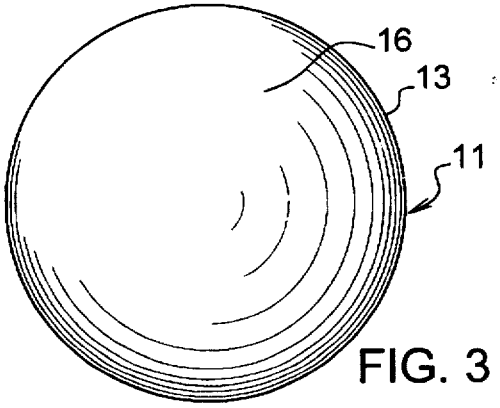
FIG. 3 is a top view of an optical lap made according to the present invention.
Figure 4:
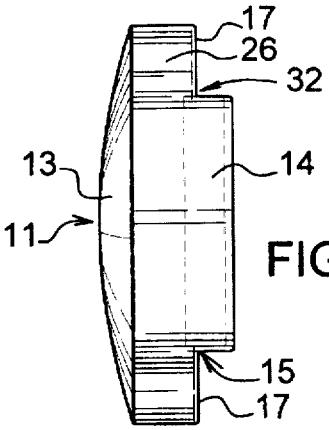
FIG. 4 is an end view of an optical lap made in accordance with the present invention showing the reinforcement member extending normal to the end in phantom lines.
Figure 5:
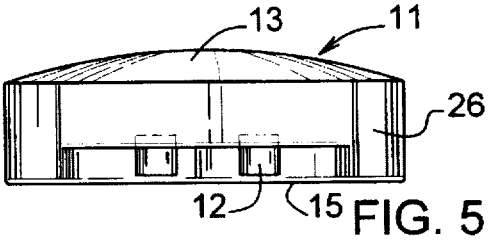
FIG. 5 is a side perspective view of an optical lap made according to the present invention, with the device oriented domed surface down showing the ends of the reinforcement members extending through the webbing and the portion of the reinforcing member embedded within the webbing being shown in phantom lines.
Figure 6:
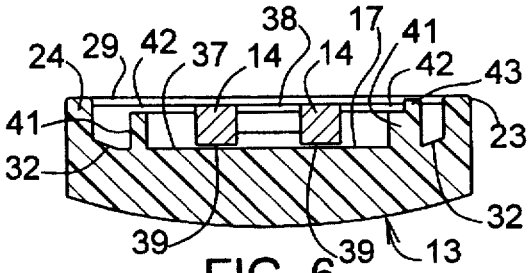
FIG. 6 is a sectional view of FIG. 7 along lines 6—6 showing the reinforcement members integrally embedded within the webbing of an optical lap made in accordance with the present invention.
Figure 7:
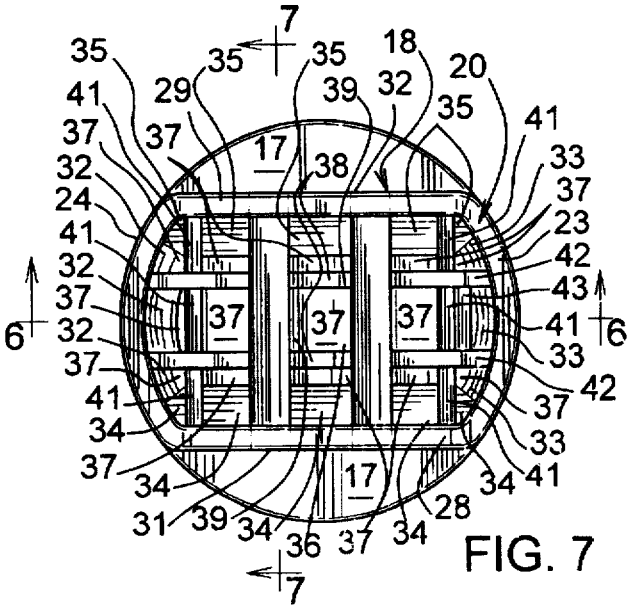
FIG. 7 is a bottom plan view of an optical lap made in accordance with the present invention.
Figure 8:
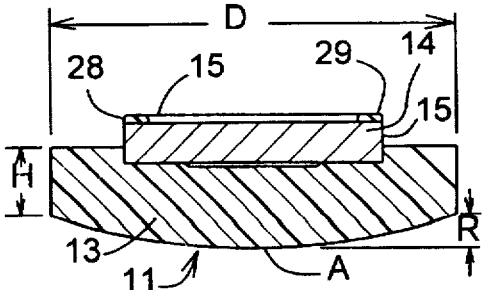
FIG. 8 is a sectional view of FIG. 7 along lines 7—7 showing the reinforcement members integrally embedded within the webbing of an optical lap made in accordance with the present invention oriented in the same fashion as FIG. 4.

As best shown in FIGS. 2 and 7, the offset of the preferred embodiment of the lap 11 includes a continuous base peripheral rail 20 defined by a straight pair of parallel base side rails 28 and 29 and connecting end rails 22 and 23. The exterior walls 24, and 25 respectively of the end rails 22 and 23 are flush with the dome side wall 26. The base side rails 28 and 29 inwardly offset with respect to the curved wall surface 26 of the dome 13 forming a step 30 defining a pair of opposing base rail side walls 31 and 32 extending downwardly from the dome body 13 to the lower flat dome body surface 17 which extends outwardly normal to the side walls 31 and 32 to the curved wall surface 26 of the dome 13. The parallel base side rails 28 and 29 support the lap 11 whereby the side walls 31 and 32 of the base 15 are secured within the clamps of the chuck of the optical lap cutter. The clamps hold the lap base 15 of the lap 11 in a vise like fashion under great pressure in order to hold the lap 11 secure during the high speed vibratory cutting and grinding procedure.

Both the parallel base side rails 28 and 29 and connecting end rails 23 and 24 of the peripheral base rail 20 define angled inside walls sloped inwardly toward the center of the main body 15 and toward one another providing a thicker rail at the intersection of the lower flat surface 17 to provide additional structural strength and dimensional stability to the peripheral base rail 20 and the base 15 during use for attaching the lap 11 to a lap grinding machine, a lap cutter, or an optical polishing machine. The floor 37 of the base webbing 18 is recessed into the dome body 13 about 0.45 inches which is a greater depth than from the continuous peripheral rail 20 to the flat bottom surface 17 of the dome 13 of about 0.25 inches, in order to provide additional structural strength and resist lateral shearing forces. It has been found that to avoid movement of the domed portion 13 imparted by the clamping pressure of the lap cutter clamps, it is advisable that side rails 28 and 29 are presented in sloped fashion with the rails 28 and 29 being thicker at the point, (intersection of base 15 and dome 13), where they contact the floor of the base webbing 18 below the lower surface of dome 13 than they are at their terminal flat surfaces. The slope extends upward from the base webbing floor 37 a distance equal to the lower dome surface 17; however, the slope could extend to the top of the rails 24, 25, 28, 29 if necessary, depending upon the available space within the webbing 18. The amount of slope provided to end rails 23 and 24, and the side rails 28 and 29 may vary substantially, such that the amount of open space of the webbing 18 will vary accordingly. In the preferred embodiment, about 25 degrees of slope is provided to the curved end rails 23 and 24 to form curved inner end sloping walls 32 and 33; however, the inner end sloping walls 32 and 33 may be formed without the curve and the slope may range from about 1 to about 90 degrees and more preferably from about 1 to about 45 degrees. It is also possible to form the base 15 without the sloping end rail walls 32 and 33; however, the structural strength of the base 15 would be reduced accordingly. In the preferred embodiment, about 45 degrees of slope is provided to the straight side rails 28 and 29 to form inner side rail sloping walls 34 and 35; however, the inner end sloping walls 34 and 35 may range from about 1 to about 90 degrees and more preferably from about 1 to about 60 degrees. It is also possible to form the base 15 without the sloping side rail walls 34 and 35; however, the structural strength of the base 15 would be reduced accordingly.

As best shown in FIGS. 2 and 7, base 15 is provided with a centrally located generally square center recess 36 having a pair of side walls 38 extending upwardly from the webbing floor 37 about 0.10 inches and is spaced apart slightly from the sloped rail side walls 34 and 35. The center recess walls 38 could be higher; however, the walls 38 are sized to hold the chuck of a lap cutter and provide a means for easy insertion and removal of the chuck. The end walls 39 of the center recess 36 extend upwardly less than 0.05 inches and below the level of the lower dome surface 17, and are wider in width sized to support a pair of reinforcement members 14 described heretofore which provide the dimensional stability and strength to the base 15. The center recess 36 has dimensions of about ½ square inches, in a manner to be adaptable to fit within the chuck of an optical lap cutter machine. The center recess 36 is provided to accommodate a protrusion on the chuck of a typical optical lap cutter machine where the lap 11 is held in place while cutting/grinding it to its necessary contour. Of course, the specific form of center recess 36 is not integral to the invention, but is provided merely to accommodate the lap cutting geometry of the typical lap cutter.

In the preferred embodiment the reinforcement members 14 are longitudinal bars of steel having a rectangular cross-section. The reinforcement members 14 are integrally molded and embedded in the thermoplastic polymer as a part of the lap base 15 and dome 13 using an over-molding process wherein magnets are used to hold the metal reinforcement members 14 in position within the mold. The inner surface of the reinforcement members 14 rest on the top surface of the center recess end walls 39, but below the flat bottom dome surface 17 and intersect a portion of the center recess side walls 38. The distal ends 12 of the reinforcement members 14 extend through the sloped side walls 34 and 35 so that the thermoplastic material forming the side rails 28 and 29 cover the tops of the reinforcement members 14. The reinforcement members 14 extend through the base side rails 28 and 29 ending flush with the rail side walls 31 and 32, respectively, wherein a portion of the distal ends 12 are visible above the flat bottom dome surface 17. Upon placing the base 15 of the lap 11 between the clamps of a lap cutting apparatus, the distal ends 12 of the reinforcement members 14 are oriented normal to the clamp jaws in order to dissipate the stress and minimize flexing of the base 15.

A pair of straight end walls 41, each one being positioned between a reinforcement member 14 and the respective curved end wall 22, 23 extends from sloped side wall 34 to sloped side wall 35. The end walls 41 extend upward from the webbing floor 17 about the same distance as the sloped side walls 22 and 23.

A pair of straight inner side walls 42, each pair being positioned between and parallel to the sloped side walls 34 and 35 and normal to the reinforcement members 14 extend from a curved end wall 22 or 23 respectively to abut against the reinforcement member 14. The inner side walls 42 are in alignment with the center recess side walls 38 and extend upward from the webbing floor 17 about the same distance as the reinforcement members 14 which is slightly greater than the end walls 41, but less than the peripheral rail 20.

A locator tab 43 is positioned on one side of the base webbing 18 extending between and normal to the inner side walls 42 and contiguous with the end wall 41, located between the end wall 41 and sloped end wall 32. The locator tab 43 extends outwardly from the webbing floor 17 about the same distance the peripheral rail 20 providing a means for locating the cutting, grinding, or polishing equipment.

The foregoing description should be construed as limiting the scope of the invention herein disclosed in any fashion, as those skilled in the art will readily appreciate that the invention in many obvious variations, without departing from the scope or spirit of the invention.

I claim:

1. An optical lap of unitary construction comprising a thermoplastic polymer resin of uniform density, porosity, and texture throughout formed having a solid main body with a generally domed-shaped upper head portion of substantially monolithic form providing an upper curved surface and a lower flat surface having an attachment means defining an integral base portion extending downward opposite the lower flat surface offset from said main body, said integral base portion, comprising:

webbing having a continuous peripheral rail extending therearound;

said continuous peripheral rail including a pair of parallel side rails connecting a pair of opposing curved end rails; and at least one reinforcement member comprising harder material than said dome body and said integral base, said at least one reinforcement member being integrally formed and embedded within said webbing, said at least one reinforcement member being positioned normal to and inbetween said pair of parallel side rails.

2. The optical lap of claim 1, including a pair of reinforcement members.

3. The optical lap of claim 1, said parallel side rails defining a pair of straight sidewall surfaces extending normal to said lower flat surface offset from said main body having an angled inside wall sloped inwardly toward the center of the main body and toward one another providing a thicker rail at the intersection of said integral base with said main body to provide additional structural strength and dimensional stability to said side rails and the main body during use for attaching said lap to a lap grinding machine, a lap cutter, or an optical polishing machine.

4. The optical lap of claim 1, said dome defining a curved dome sidewall, and said integral base including opposing curved end rails defining outer sidewalls converging with said curved dome sidewall and each of said curved end rails having an angled inner sidewall sloped inwardly toward the center of the main body and toward one another providing a thicker rail at the intersection of said integral base with said main body to provide additional structural strength and dimensional stability to said curved rails and said main body.

5. The optical lap of claim 1, said reinforcement members being selected from the group consisting of steel, iron, brass, copper, nickel, fiberglass, graphite fiber, or combinations thereof.

6. The optical lap of claim 1, wherein said thermoplastic polymer is selected from the group consisting of nylon, polyvinyl chloride, polypropylene, polyethylene, acrylonitrile butydiene styrene, polycarbonate, or combinations thereof.

7. The optical lap of claim 6, wherein said thermoplastic polymer is augmented with filler, selected from the group consisting of glass fibers, mineral fillers, or carbon fibers.

8. The optical lap of claim 7, wherein the percentage of said mineral filler in said thermoplastic is between 25 and 50 percent by weight of said thermoplastic, the remainder being comprised of thermoplastic resin.

9. The optical lap of claim 8, wherein said mineral filler is talc.

10. The optical lap of claim 1, including a locator tab.

11. The optical lap of claim 1, said webbing defining a recessed center.

* * * * *